United States Patent [19]

Kourimsky et al.

[11] Patent Number: 4,483,581

[45] Date of Patent: Nov. 20, 1984

[54] ELECTRICAL EDGE CONNECTOR

[75] Inventors: Friedrich J. A. Kourimsky, Bensheim; Klaus G. Seidel, Roedermark, both of Fed. Rep. of Germany

[73] Assignee: AMP Incorporated, Harrisburg, Pa.

[21] Appl. No.: 401,666

[22] Filed: Jul. 26, 1982

[30] Foreign Application Priority Data

Aug. 7, 1981 [GB] United Kingdom ..... 8124136

[51] Int. Cl.[3] ..... H01R 13/50

[52] U.S. Cl. ..... 339/176 MP; 339/17 LC

[58] Field of Search ..... 339/176 MP, 176 MF, 339/17 M, 17 LM, 17 LC, 17 F

[56] References Cited

U.S. PATENT DOCUMENTS 3,848,952 11/1974 Tighe, Jr. ..... 339/176 MP
3,969,010 7/1976 Nailor et al. ..... 339/176 MP
3,989,336 11/1976 Rizzio, Jr. et al. ..... 339/176 MF
4,003,625 1/1977 Vladic ..... 339/176 MP
4,142,226 2/1979 Mears ..... 361/380
4,186,988 2/1980 Kobler ..... 339/176 MP
4,275,944 6/1981 Sochor ..... 339/176 MP

FOREIGN PATENT DOCUMENTS 2413989 9/1974 Fed. Rep. of Germany .
2027560 2/1980 United Kingdom .

*Primary Examiner*—John McQuade
*Assistant Examiner*—Thomas M. Kline
*Attorney, Agent, or Firm*—F. W. Raring

[57] ABSTRACT

An electrical edge connector suitable for Liquid Crystal Displays has contacts arranged at a housing slot with contact tails extending in a row, transversely of the slot, the tails being connected to the contacts by resilient bight portions of U-form arranged in a row to allow for resilient flexure between the tails and the contacts.

2 Claims, 5 Drawing Figures

ELECTRICAL EDGE CONNECTOR

This invention relates to an electrical edge connector of a kind generally known for effecting electrical connections to the edge of a printed circuit board or substrate. Such a connector comprises an elongate housing formed with a slot for receiving the edge of the board or substrate, and contacts mounted in the housing having resilient contact portions bordering the slot for engaging conductive paths at surfaces of the board adjacent the edge.

It is known in such a connector to have tail portions of the contacts extending from the housing in a direction transversely of the slot for connection to further circuitry. Such an arrangement is suitable for mounting the board or substrate in a panel-like array by releasable connection of the tail portions in complementary sockets, so that the board or substrate is generally coplanar with or parallel to the panel. A particular application arises, for example in instrument panels for automobiles, where due to restricted access and space, there is often the need for assembly of circuitry from the front of the panel both at initial installation and for maintenance purposes. An important application in this respect is the introduction of Liquid Crystal Display panels (LCD) which comprise flat substrates of glass or like material carrying circuitry and display devices, but due to the fragile nature of these LCD substrates, there is substantial risk of damage during mounting or dis-mounting the display in the panel.

It is an object to provide an edge connector suitable for releasable mounting of a circuit substrate in a panel and to protect against damage resulting from insertion or withdrawal forces and forces which might arise from mechanical vibration during service.

According to the invention, an edge connector comprises an elongate insulating housing formed with a slot for receiving the edge of a circuit substrate, contacts mounted in the housing having resilient contact portions disposed at intervals along the slot for engaging circuit paths at the edge of the substrate and contact tails extending from the housing transversely of the slot, is characterised by the contact tails extending in U-fashion about bights arranged in a row extending generally parallel to the slot with end portions bent transversely away from the slot for releasable connection with complementary connections.

Suitably the housing is formed at a side opposite the slot with a membrane-like extension formed in U-fashion to support the tail-bights and at a free edge portion the membrane-like portion extending away from the housing transversely of the slot to support end portions of the contact tails. Advantageously the end portions of the contact tails pass through apertures in a support portion of the membrane-like portion and are positioned alternately on opposite sides of the free edge portion so that the tail portions on the opposite side are at double the pitch of the contact portions in the housing. The tail end-portions are suitably formed as tabs of increased width compared with bight portions of the contacts, and side edges of the tab portions are suitably located in supporting grooves extending from the support portion to the free edge of the membrane-like extension.

The free edge portion of the membrane-like extension having rows of contact tabs on opposite sides is suitable for releasable connection with a double-sided edge-connection of conventional construction and which may be rigidly mounted in an instrument panel assembly. In use, edge connectors according to the invention are engaged with opposite edges of a substrate or LCD, with the free edges of the membrane-like extensions projecting from the same side, and the assembly is then mounted by engaging the free edge portions with respective connectors. The bight portions provide flexibility which protects against excessive forces being applied to edges of the substrate and such resilience as to provide a shock absorbing effect.

The invention will now be described by way of example with reference to the accompanying partly diagrammatic drawings, in which.

Figure 1:
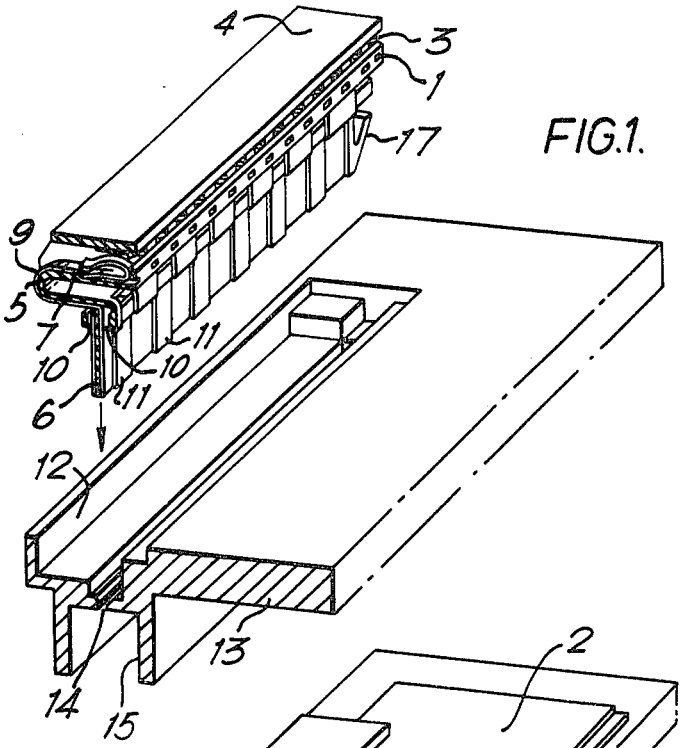
FIG. 1 is a fragmentary exploded perspective view of a connector according to the invention positioned for assembly in a panel base plate.
Figure 2:
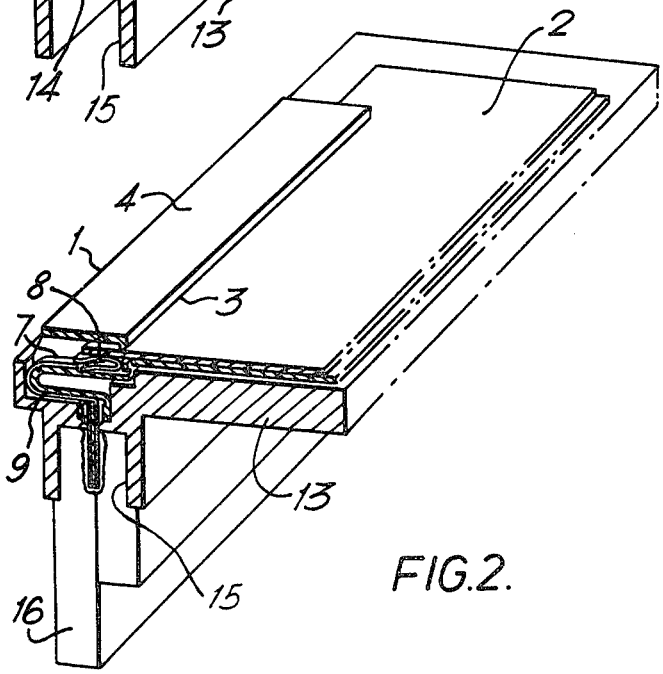
FIG. 2 is a fragmentary assembled perspective view of the parts of FIG. 1 with a display substrate and a complementary connector.

In FIGS. 1 and 2 an edge connector 1, according to the invention, is adapted to receive the edge of a Liquid Crystal Display panel 2 in a slot 3. The connector 1 comprises a slab-like housing portion 4 formed along one side with the slot 3 and at an opposite side with a membrane-like extension 5 formed in U-fashion to extend initially below and in spaced relation from the housing portion 4, and at an end portion 6 extending downwardly, transversely away from the slot 3. Contacts 7 are mounted within the housing at spaced intervals along the slot 3 at which they present resilient contact portions 8 for engaging an underside of the LCD panel. Tail portions 9 of the contacts extend from the housing externally around the U-form of the extension and pass through apertures 10 formed in a support portion of the extension 5 at a transition between the U-form and the downwardly extending end portion 6. Tail portions of alternate contacts are arranged on opposite sides of the portion 6 and are formed as tabs 11 of increased width relative to the contact portions within the housing 4 and parts of the tail portions surrounding the U-form.

After receiving the edge of the LCD panel, the connector 1 is mountable in a recess 12 formed in a light conducting base plate 13 suitably forming part of an instrument panel or like display. The plate 13 is formed at the foot of the recess 12 with a slot 14 through which the downwardly extended end portion 6 of the housing extension 5 extends into a downwardly facing recess 15 adapted to receive an edge-connector 16 for mating engagement with the tabs 11 on opposite sides of the extension. The extension is suitably formed at opposite ends with latch ears 17 adapted releasably to latch the connector 1 into the recess 12 of the plate 13.

Figure 3:
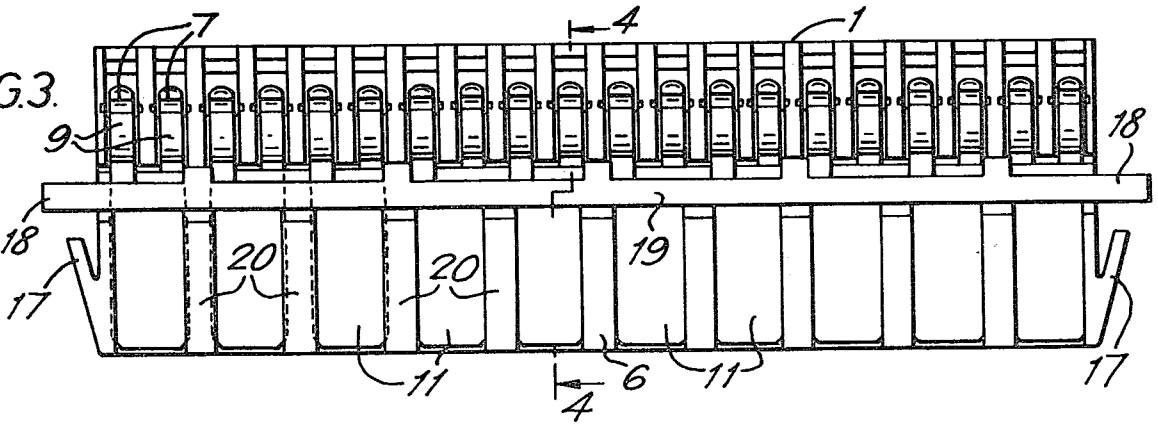
FIG. 3 is a side elevation of a connector according to the invention.

The connector will now be described in greater detail with reference to FIGS. 3 to 5. As seen in FIG. 3, flanges 18 are formed at the opposite ends of the connector at the transition between the U-form membrane portion 5 and the downwardly extending portion, spaced above and opposed to the latch ears 17 for receiving edge portions of the base plate recess floor between them. A flange portion 19 extends from end to end of the connector between flanges 18, and projecting on opposite sides of portion 6 and the flange portion 19 is formed on opposite sides of portion 6 with the apertures 10 through which tail portions 9 of the contacts extend. The membrane-like portion 5, as seen in FIGS. 4 and 5, extends to a side of the flange portion 19, the right as seen in FIG. 4 and the upper as seen in FIG. 5, to allow the tail portions 9 to pass across the flange portion alternately into apertures 10 on opposite sides of portion 6.

The portion 6 is formed with a series of downwardly extending parallel ribs 20 defining between them recesses for the tabs 11 and facing sides of the ribs 20 are grooved to receive side edge portions of the tabs 11. By virtue of the alternating disposition of the tabs 11 on opposite sides of the extension 6, the tab portions 11 at each side are at twice the pitch of the contacts 7 to allow for the increased tab width. The increased width and pitch is desirable in that the connector 16 is desirably of a kind normally used in the commercial or automotive field, whereas the LCD panel requires a close pitch as is normal in electronics type applications.

Figure 5:
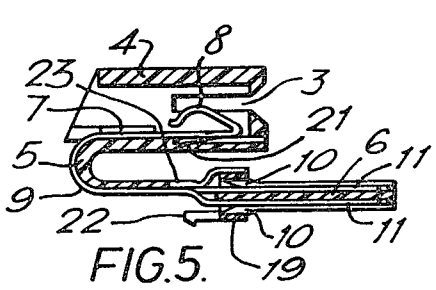
FIG. 5 is a view similar to that of FIG. 4 but in a partially assembled condition.
Figure 4:
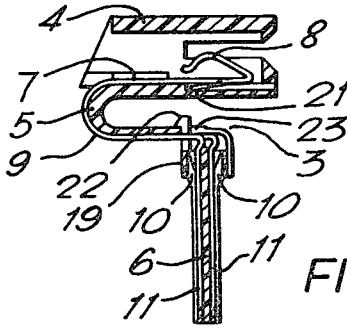
FIG. 4 is a section taken on the line 4—4 of FIG. 3.

The connector of FIGS. 3 and 4 is suitably manufactured initially in the form shown in FIG. 5 with the extension portion 6 projecting from the lower side of the U-form portion 5 and extending sidewardly. The contacts are initially in U-form, with the tab portions 11 extending sidewardly from lower limbs of the U-shaped part of the tail portions 9, so that the contacts may be assembled into the housing from left to right, the contact portions 8 entering the housing and being retained therein by integral latches 21, the tab portions 11 passing alternately through apertures 10 above and below the extension portion 6, below the lower side of the U-form membrane-like portion 5. From this condition the membrane-like portion adjacent the flange portion 19 is bent in hinge manner and the contact tails 9 are bent similarly to position the tabs 11 and extension 6 in downwardly extending manner as shown in FIG. 4. Hook members 22 project upwardly from the flange portion 19 at a side remote from the junction of the extension portion 5 with the flange portion 19, and engage corresponding apertures 23 in the membrane-like portion 5 to hold the extension 6 in the upright position. The apertures 23 serve to weaken the membrane-like extension 5 to facilitate bending at the desired location.

What is claimed is:

1. An electrical edge connector comprising an elongate housing formed with a slot for receiving the edge of a circuit substrate, the housing being formed at a side opposite the slot with a membrane-like extension formed with a U-fashion section adjacent to the slot, the membrane-like extension having a free edge portion which extends laterally from the U-fashion section away from the slot, the U-fashion section and the free edge portion extending parallel to the slot, contacts mounted in the housing having resilient contact portions disposed at intervals along the slot for engaging circuit paths at the edge of the substrate, the contacts having contact tails extending from the housing tranversely of the slot, the contact tails extending in U-fashion around and against the U-fashion section of the membrane-like extension, the contact tails having end portions which extend across the free edge portion of the membrane-like extension, the end portions of the contacts being arranged in a row extending generally parallel to the slot.

2. A connector as claimed in claim 1, in which the end portions of the contact tails pass through apertures in a support portion of the membrane-like portion and are positioned alternately on opposite sides of the free edge portion.

* * * * *